US005555952A

United States Patent [19]

van Mol et al.

[11] Patent Number: 5,555,952

[45] Date of Patent: Sep. 17, 1996

[54] PLATFORM, ADJUSTABLE IN HEIGHT

[75] Inventors: Johannes C. F. van Mol, Diessen; Johannes B. M. Ockhuizen, Tilburg; Antonius H. J. Smits, O-Wen Middelbeers, all of Netherlands

[73] Assignee: HEK Manufacturing B.V., Middelbeers, Netherlands

[21] Appl. No.: 227,436

[22] Filed: Apr. 14, 1994

[30] Foreign Application Priority Data

Apr. 14, 1993 [NL] Netherlands ..... 9300629

[51] Int. Cl.[6] ..... E04G 1/20

[52] U.S. Cl. ..... 182/18; 182/141

[58] Field of Search ..... 182/18, 148, 131, 182/141, 146, 63

[56] References Cited

U.S. PATENT DOCUMENTS 3,965,464 6/1976 Kozai ..... 182/184
4,293,054 10/1981 Pieri ..... 182/148 X
4,498,556 2/1985 Garton ..... 182/148

FOREIGN PATENT DOCUMENTS 8603300 7/1988 Netherlands ..... B66B 9/18
2187708 9/1987 United Kingdom ..... B66C 13/16
WO92/06258 4/1992 WIPO ..... E04G 1/20

*Primary Examiner*—Alvin C. Chin-Shue
*Attorney, Agent, or Firm*—Pennie & Edmonds

[57] ABSTRACT

A platform is equipped with a chair, which chair is displaceable along a mast, and to which chair platform components can be affixed, whereby, force indication means are incorporated between the chair and the platform components so that an indication can be provided concerning the differences in the mechanical loading of the platform components located at opposite sides of the chair.

A simple embodiment arises through the application of a beam which is freely-spanned with respect to the chair and which is connected in a hinged manner with the platform components, within which beam force indication means are incorporated.

11 Claims, 1 Drawing Sheet

PLATFORM, ADJUSTABLE IN HEIGHT

FIELD OF THE INVENTION

The current invention pertains to a platform equipped with a chair, which chair is displaceable along a mast, to each side of which platform a platform component can be affixed.

BACKGROUND OF THE INVENTION

Such platforms, also referred to as scaffold-lifts, are generally known. Known lift-scaffolds, scaffoldings and working platforms, which are mobile and which can be assembled in situ from modular sections or parts, are often placed adjacent to or against buildings or walls as an aid to building repair or maintenance duties. Under such circumstances, a load with personnel is placed on the platform, which load and personnel are subsequently displaced on the platform alongside the mast.

The disadvantage of the known platforms is that circumstances are imaginable in which such forces exist that danger to material or persons cannot be ruled out.

SUMMARY OF THE INVENTION

The aim of the current invention is to remove said disadvantage by providing a platform which is safer and which does not give rise to potentially dangerous situations even under a greater range of circumstances.

To that end, the platform according to the invention is characterised in that force indication means are fitted at least between one of the platform components and the chair.

The advantage of the platform according to the invention is that, as a result of the mounting of the force indication means in the manner shown, said force indication means provide an indication of the forces arising between the platform component and the chair, which, in their turn, exert a torque or bending force on the mast. The indication provides the possibility of warning when a mechanical overloading or imbalance occurs in the platform as a result of an excessive loading of one side of the mast, which overloading or imbalance could lead to dangerous situations.

An embodiment of the platform in accordance with the invention is characterised in that force indication means are fitted between each component and the chair.

In such an embodiment of the platform in accordance with the invention, an insight is gained in the degree of imbalance and the thereby related magnitude of the difference-forces which arise in the platform components on each side of the mast from the differences between the indications provided by each of the force indication means for the forces which arise. Additionally, this embodiment provides the possibility in principle to determine the forces arising in each of the related platform components individually in an absolute sense, so that in this manner is simultaneously possible to monitor the total loading of the platform.

In a further embodiment of the platform in accordance with the invention, the force indication means are inserted mechanically in series with elastic means, whereby a dynamic absorption of forces by the elastic means occurs while the platform is stationary, during its loading, for example, and in particular, during the process of starting or stopping the motion of the platform.

The elastic means are preferably mechanically pre-tensed, so that the elastic means are only switched in during a substantial loading in order to prevent unstable behaviour of the platform in accordance with the invention.

A further embodiment of the platform in accordance with the invention is characterised in that the force indication means and/or the elastic means are placed mechanically in parallel with striking means.

Of advantage is the fact that these striking means limit the maximum force exerted on the force indication means and/or the elastic means, so that in the case of possible overloading the aforementioned means are not damaged, which damage could otherwise inhibit their correct functioning.

A further embodiment of the platform in accordance with the invention is characterised in that at least one of the fixing points between the platform component and the chair is embodied in a hinged fashion.

This embodiment is to be preferred, because in practice, the force indication means are embodied in such a manner that they absorb force if slightly compressed or extended in order to provide the desired indication, so that the related small movement of the platform component in question can be absorbed by the hinged fixing point.

In a particular preferential embodiment, a beam which is freely-spanned with respect to the chair is fixed between the corresponding lowest hinged fixing point of the platform components, which beam allows a movement of the lowest hinged fixing point of the platform components with respect to the chair.

The advantage hereof is that in this embodiment the force indication means can be implemented only once and, if desired, can be mounted in the beam itself.

Moreover, it is particularly preferable when the force indication means are embodied electronically to connect same to an affixation switch, so that a periodic feeling and checking of the correct working of the electronic force indication means can take place, so that a safe operation of the eccentric overload protection realised in this manner is guaranteed.

Furthermore, it is preferable to control the protection circuit by means of a microprocessor, whereby the microprocessor is programmed in such a manner that disturbances in the further platform control system can be checked by means of a regular self-checking, and it is possible to take corrective actions in a timely manner and to return to a situation which is safer for the platform.

It is to this end that the protection circuit on the displacement means for the chair contains connected releasing means, so that the platform can be released as soon as the overload situation no longer exists.

The current invention and its further related advantages shall now be further elucidated on the basis of the attached figures, in which corresponding elements will be provided with the same reference numbers. The contents of the figures are as follows:

DETAILED DESCRIPTION OF THE INVENTION

Figure 1:
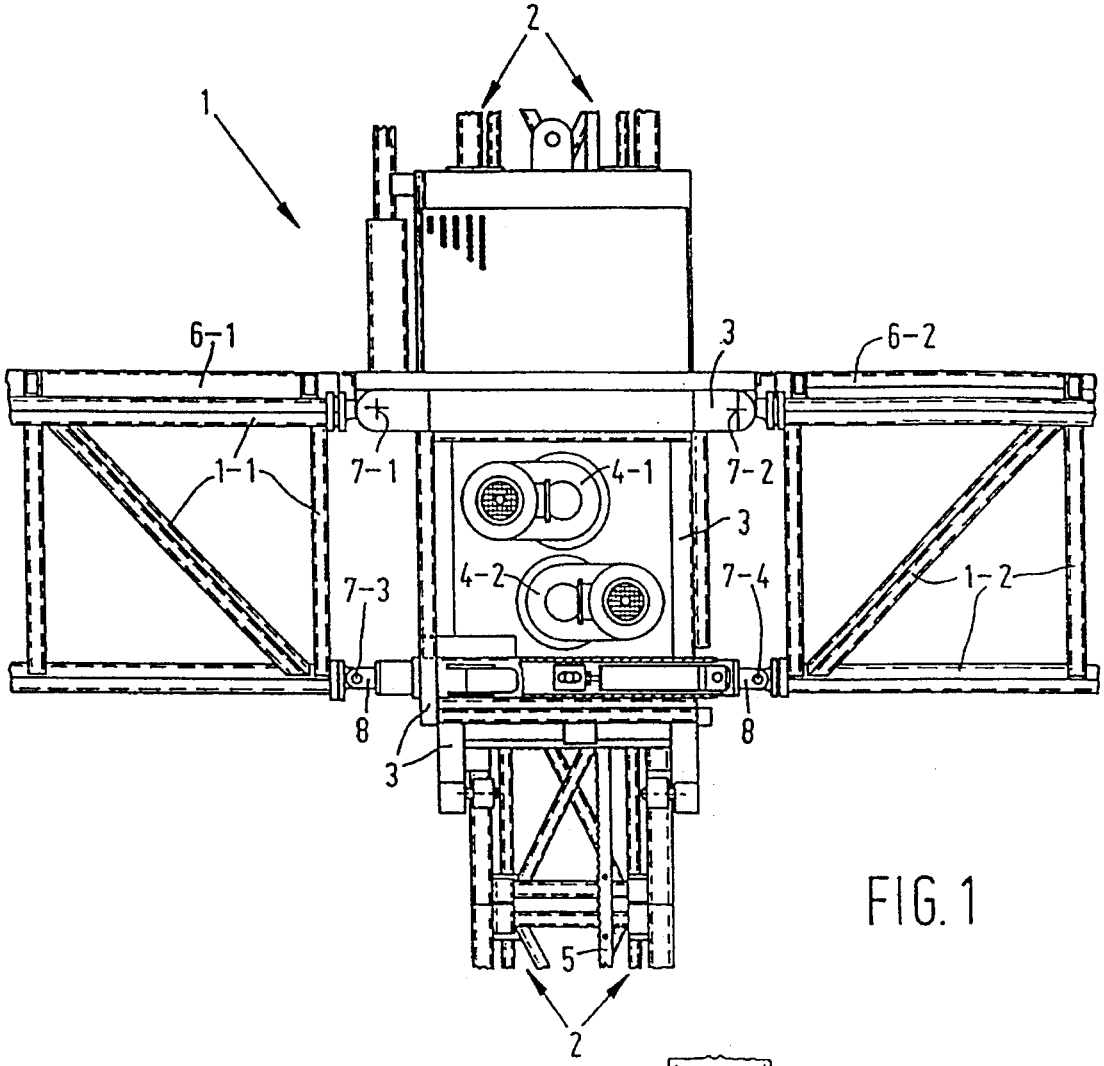
FIG. 1 shows a relevant portion of a possible embodiment of the platform according to the invention.

FIG. 1 shows a depiction of a platform 1 which is composed of a mast 2, along which mast 2 a chair 3 can be adjusted in height with the aid of displacement means 4. The adjustment takes place with the aid of two motors 4-1 and 4-2, which motors cause one or more non-depicted cog-wheels to rotate, which cog wheels are connected to a pinion 5 affixed to the mast 2.

In the partially-depicted embodiment, platform components 1-1 and 1-2 are affixed on opposite sides of the chair 3. Cover plates 6-1 and 6-2, respectively, are situated on the platform components 1-1 and 1-2, which platform components 1-1 and 1-2 are generally constructed downwards towards a point and are, for example, v-shaped, and which cover plates 6-1 and 6-2 serve as a loading floor. In the embodiment depicted here, the platform components 1-1 and 1-2 are affixed to the chair 3 by means of upper hinging fixing points 7-1 and 7-2, inclusive. FIG. 1 shows that a beam 8 is fixed between the two lower hinging fixing points 7-3 and 7-4, within which beam 8, force indication means 9 are fitted between the lower fixing points 7-3 and 7-4. The force indication means 9 are usually embodied electrically, with the aid of, for example, a piezo electric crystal, or on the basis of stretch-strips, in order to provide information in some manner concerning the magnitude and type of the force, that is to say a pulling or pushing force, which is being exerted. In the embodiment of the beam 8, the force indication means 9 are in integrated in such a manner that only a difference in applied-force is measured, which difference is a result of a difference force, with which force, as a result of a possible difference between the loading occurring on the cover plates 6-1 and 6-2, or otherwise as a consequence of the non-symmetrical construction of the platform 1, the lower fixing points 7-3 and 7-4 are pushed towards each other. To this end, the beam 8 is equipped with a block 10, within which block 10 a boring 11 has been implemented. A blocking pin 12, which is fixed to the chair 3, is fixed within this boring 11. The beam 8 is freely-spanned with respect to the chair 3 and is capable of motion to some degree in its longitudinal axis. If the force on one the lower fixing points 7-3 or 7-4 is greater than the force on the other fixing point 7-4 or 7-3, the beam moves somewhat with respect to the blocking pin 12 on the block 10 with the result hereof being that whenever the force at point 7-4 in the direction of the block is greater than the force at point 7-3 on the block 10, a pushing-force arises in the force indication means 9. In the opposite situation, a pulling-force is experienced in the means 9. This force is the result of a difference-force which arises in the respective platform components 1-1 and 1-2, which force in turn is a result of a difference, for example, between the weights of the loads which are placed on the cover plates 6-1 and 6-2 of the different platform components 1-1 and 1-2. By emitting an electric signal, the force indication means 9, which are usually electric, provide an indication regarding the platform component which is most heavily loaded, whereby, in this manner, information is also provided concerning the magnitude of the force which plays a role herein and which force is exerted in the mast 2 in the form of a torque or bending force.

It should be clear that, based on the aforementioned given situation, variants are possible whereby, for example, in the connection route between the fixing point 7-3 and the chair 3, for example, force indication means 9 are incorporated, and also, whereby in a similar manner, force indication means 9 are incorporated in the connection route between the fixing point 7-4 and the chair 3. In that case, it is even possible that an insight is provided on a per-platform-component 1-1 and 1-2 basis into the magnitude of the previously mentioned bending force caused by each component.

Figure 2:
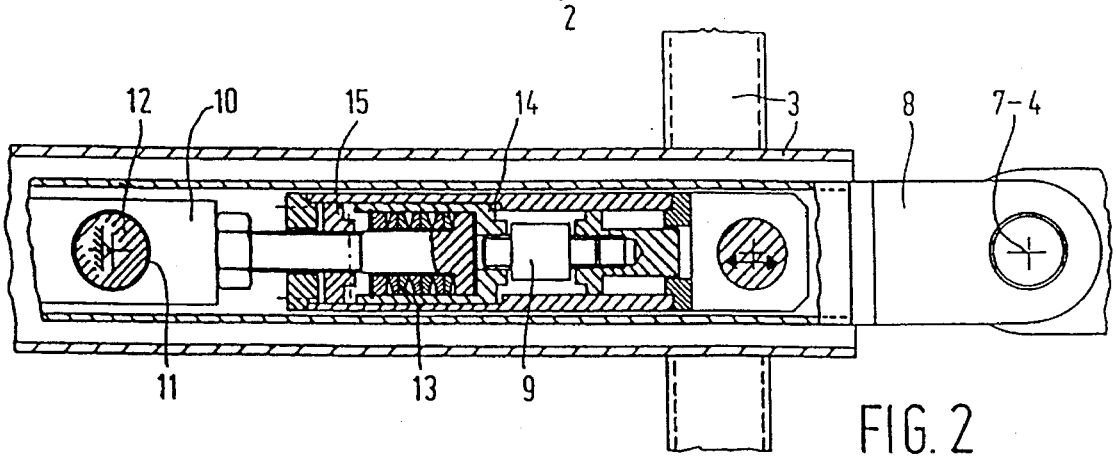
FIG. 2 depicts a detail view of the arrangement of a beam which is to be used in the embodiment shown in FIG. 1.

FIG. 2 shows that elastic means 13 are incorporated in mechanical series with the force indication means 9, which elastic means 13 are preferably pre-tensed and which, by means of the exertion of force during the displacement of the blocking pin 12 and the block 10, can be brought under a pushing-force or otherwise under a pulling-force. The beam 8 is equipped with striking means 14 and 15 in order to ensure that, during exertion of a pushing force on the force indication means 9, the force cannot reach a level whereby these means could be damaged by crushing. In a similar manner, the striking means 15 are incorporated to ensure that upon extension by pulling, the degree of freedom is restricted and that, in this pulling-force case, the force indication means 9 are not damaged by being overly pulled apart.

The force indication means 9, which are preferably electronic in their embodiment, are connected to a non-depicted protection circuit which protection circuit is arranged in such a manner that the means 9 are regularly scanned, in order to regularly check if the force indication means 9 and/or the electrical connections thereto are not short-circuited, and to check that the means 9 are no longer connected as a result of an open-circuit. In this manner, an extremely safe electric load indicator is created, which indicator functions correctly under all imaginable operational circumstances. If desired, the protection circuit, which is usually embodied with the help of a microprocessor, can also be coupled to further measures for the prevention of other undesirable occurrences, and is connected to non-depicted releasing means, in order to forbid the operation of the displacement means 4-1 and 4-2 under unsafe circumstances.

We claim:

1. Platform equipped with a chair, which chair is displaceable along a mast, to each side of which platform a platform component can be affixed, characterised in that force indication means are fitted between each platform component and the chair, which force indication means are inserted mechanically in series with elastic means.

2. Platform according to claim 1, characterised in that the elastic means are mechanically pre-tensed.

3. Platform according to claim 1, characterised in that the force indication means and the elastic means are placed mechanically in parallel with striking means.

4. The platform according to claim 1, characterized in that each of the platform components has two fixing points, one located above the other and both embodied in a hinged manner and a beam is fixed between the corresponding lower hinged fixing points of the platform components, which beam is incorporated in a manner which is freely-spanned with respect to the chair, the beam being equipped with a block having a boring within which boring a blocking pin which is fixed to the chair is also fixed, and wherein the force indicating means and at least one elastic means is incorporated within the beam, said elastic means being in series with the force indicating means.

5. Platform equipped with a chair, which chair is displaceable along a mast, to each side of which platform a platform component can be affixed, characterised in that electronic force indication means are fitted at least between one of the platform components and the chair, and that the platform is equipped with a protection circuit connected to the electronic force indication means.

6. Platform according to claim 5, characterised in that the protection circuit is microprocessor controlled.

7. Platform according to claim 5 or 6, characterised in that the protection circuit contains releasing means connected to displacement means for the chair, which means only allow the displacement of the chair upon the receipt of a go-ahead from the releasing means.

8. Platform according to claim 7, characterised in that the protection circuit is embodied in a self-checking manner.

9. Platform equipped with a chair, which chair is displaceable along a mast, to each side of which platform a platform component can be affixed, characterised in that force indication means are fitted at least between one of the platform components and the chair, which force indication means are inserted mechanically in series with elastic means.

10. Platform according to claim 9, characterised in that the elastic means are mechanically pre-tensed.

11. Platform according to claim 9, characterised in that the force indication means and/or elastic means are placed mechanically in parallel with striking means.

* * * * *